United States Patent [19]

Kothmann

[11] 4,429,206

[45] Jan. 31, 1984

[54] MINIMUM LOSS MULTILAYER ELECTRICAL WINDING FOR INDUCTION HEATING

[75] Inventor: Richard E. Kothmann, Churchill, Pa.

[73] Assignee: Westinghouse Electric Corp., Pittsburgh, Pa.

[21] Appl. No.: 358,558

[22] Filed: Mar. 16, 1982

[51] Int. Cl.[3] ..... H05B 5/18

[52] U.S. Cl. ..... 219/10.79; 219/10.43; 219/10.49 R; 219/10.75; 336/62; 336/223; 310/198; 310/200

[58] Field of Search ..... 219/10.79, 10.43, 10.49 R, 219/10.75, 6.5; 336/62, 223; 310/198, 200

[56] References Cited

U.S. PATENT DOCUMENTS 1,861,870 6/1932 Long ..... 219/10.51

2,577,825 12/1951 Strickland, Jr. ..... 336/62

OTHER PUBLICATIONS

"Design and Calculation of Induction Heating Coils", R. M. Baker, AIEE Transactions, Mar. 1957, pp. 31–40.

"Current Density and Power Loss Distributions in Sheet Windings", K. Gallyas, Doctoral Dissertation, Dept. of Electrical Engineering, University of Toronto, Jan. 1975.

*Primary Examiner*—Roy N. Envall, Jr.

*Assistant Examiner*—M. M. Lateef

*Attorney, Agent, or Firm*—C. M. Lorin

[57] ABSTRACT

A minimum loss multilayer solenoid for induction heating is characterized by the ampere-turns carrying the same current per conductor from one layer to the next on account of the dimensioning of the conductors having width and thickness varying monotonically in opposite directions across the layers. Central cooling for the conductors is accommodated in the parallel layers with sectional distribution of the cooling medium.

7 Claims, 4 Drawing Figures

MINIMUM LOSS MULTILAYER ELECTRICAL WINDING FOR INDUCTION HEATING

BACKGROUND OF THE INVENTION

The frequency of the current and the amount of power passed in an electrical winding during electromagnetic transfer, be it for power transmission like in a transformer, or for the generation of heat in a workpiece, as with induction heating, are major factors which determine the size, dimensions and internal structure of an electrical winding, or coil.

While the cylindrical shape is most representative of an electrical winding, more often than not it is a mere approximation and the art is replete with coils which have ampere-turns established in a multilayer fashion of different current cross sections and overall geometry, especially where conductor insulation and cooling affect the general dimensions. Nevertheless, the superposition of ampere-turns about a common axis as if the overall shape of the winding were cylindrical, has the merit of providing a good account of the electrical characteristics and the efficiency of an electrical winding of any design. In this regard, ampere-turn dimensions, laterally and radially of the axis, are essential from a point of view of the total magnetomotive force, of field intensity, and current losses. Representative of the prior art is an Article by R. M. Baker in AIEE Transactions, Volume 26 Part II, March 1957, pp. 31–40, entitled "Design and Calculation of Induction-Heating Coils". R. M. Baker in the article, in the context of induction heating applications, considers the flux in the air gap between coil and workpoiece, the work flux which is effective on the workpiece itself, and also the flux in the copper of the coil due to magnetic field penetration. In this respect, the author distinguishes two types of effective depth of current penetration $\delta$: $\delta_c$ in the coil copper and $\delta_w$ in the workpiece. It is realized, indeed, that skin effect causes the induced current to flow in a restricted manner more or less close to the surface depending upon the field intensity and frequency. Therefore, the geometric disposition of the copper, the air gap and the workpiece are essential consideration to measure coil effectiveness. This appears from the design calculations in the Baker article, involving the effective depth of current penetration $\delta$, and current density in the copper, as well as the external factors affecting the flux. The following formula is given:

$$\delta = 5033\sqrt{\frac{\rho}{\mu f}}$$

in centimeters, where $\rho$=electrical resistivity (ohm-cm); $\mu$=relative effective magnetic permeability ($\mu=1$ in air or other non-magnetic materials like copper, brass, aluminum; $\mu$ is between 10 and 100 for iron and steel); f=frequency in cycles/sec.

Skin effect in the coil is the reverse of the same effect in the workpiece. Magnetic field intensity and current density are both maximum on the inner radius of the coil turns and drop off exponentially along the radius outwardly. It is $\delta_c$ calculated for the depth of current penetration in copper which determines this current distribution. Likewise, $\delta_w$ around the periphery of the workpiece is known. It follows that coil and workpiece resistances are known. They determine the associated losses in the copper and effective heat generation $RI^2$ in the workpiece.

The problem of losses becomes particularly acute in induction heating where high current densities are encountered. An approach to cope with this problem has been to use multiple layers of thin strap conductors to reduce power losses in the winding. However, this is at the expense of water cooling which cannot be easily accommodated on, or between, such thin layers of copper. This is in contrast to present cooling practice consisting of using rectangular copper cross-sections allowing a round, or rectangular, axial "hole" in the copper through which cooling water is forced to flow. Therefore, it is desirable to minimize power losses in a coil having rectangular-shaped copper cross-sections arranged for a central cooling passage.

In keeping with ampere turns having a definite thickness to accommodate inner copper cooling, the present invention takes advantage of the conclusions reached by Ketalin Gallyas in a thesis delivered at the University of Toronto, Canada, entitled "Current Density and Power Loss Distribution in Sheet Windings". In this paper, the author has developed a theory for the minimization of losses in multilayer windings. The model used for such theory consists of sheets of copper arranged in a multilayer fashion to form the "coil", and an optimum thickness for the layers is calculated. The optimum layer thickness $b_{opt}$ for a coil with q layers is given by the formulae:

$$b_{opt}=1.3\delta/q$$

when $q \geqq 2$, and $$b_{opt}=1.57\delta,$$

q when q=1.

As a result of such optimization, Gallyas has shown that the ratio of loss $P_q$ in a winding of q layers, as opposed to the loss $P_1$ in a single layer winding is:

$$\frac{P_q}{P_1} = \frac{1.21}{\sqrt{q}} \text{ (if } q \geqq 2).$$

The conclusions of Gallyas in her thesis have been based on a winding supporting the same current in each layer, while all layers have been given the same $b_{opt}$ thickness. The results obtained by Gallyas are as shown in Table I herebelow:

TABLE I

| Number of layers (q) | Loss Ratio for Fixed Current and Thickness ($P_q/P_1$) |
|---|---|
| 1 | 1.000 |
| 2 | .856 |
| 3 | .699 |
| 4 | .605 |
| 5 | .541 |
| 6 | .494 |
| 7 | .457 |
| 8 | .428 |

SUMMARY OF THE INVENTION

According to the present invention, a multilayer electrical winding includes ampere turns distributed about a common axis so that a substantial thickness radially of the axis and a substantial width longitudinally of the axis are selected for each ampere turn such that the same current per conductor is maintained from one layer to the next, the thickness being progressively reduced and the widths being progressively lengthened between successive layers from the outside to the inside of the winding.

DESCRIPTION OF THE PREFERRED EMBODIMENTS OF THE INVENTION

Figure 1:
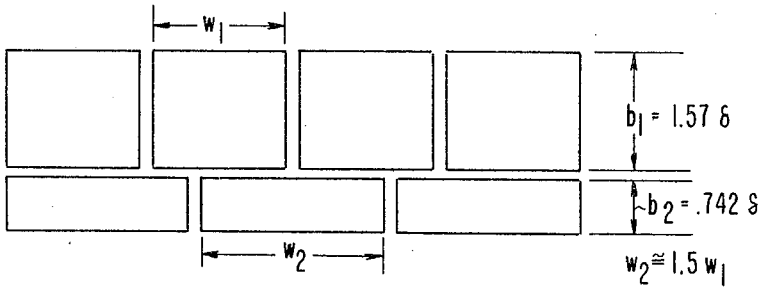
FIGS. 1–3 illustratively show multilayer electrical windings according to the invention for two, three and four layers, respectively.

The invention amounts to an optimization of both the thickness and the current density of each layer as opposed to the prior art solution in the thesis of Gallyas admitting the same current in each layer and the same thickness throughout all the layers.

Such optimization is effective on the total loss reduction in any layer of rank q in the winding, the requirement being that the total current per unit axial length of the winding remain the same. The mathematics on which rests such thickness b and width w optimization for a current density J are developed in the Appendix hereinafter to summarize the calculations:

$$I_i = A_i \cdot J_i$$

where the area of an ampere turn is $A_i = b_i \cdot w_i$ for a layer of rank i; and $J_i$ is the current density resulting from a current $I_i$ flowing into the copper cross-section $A_i$. For each turn of rank i the number of ampere turns is $I_i$.

The results of this optimization are shown in Table II which presents power loss relative to an optimum single layer coil for the present method and for the Gallyas method of optimization.

TABLE II

| Number of Layers | Optimum Loss Ratio with Variable Current and Thickness | Gallyas' Loss Ratio with Fixed Current and Thickness |
|---|---|---|
| 1 | 1.000 | 1.000 |
| 2 | .687 | .856 |
| 3 | .556 | .699 |
| 4 | .479 | .605 |
| 5 | .427 | .541 |
| 6 | .389 | .494 |
| 7 | .360 | .457 |
| 8 | .336 | .428 |

Table II shows that an optimum 2-layer coil has lower loss than the Gallyas 3-layer coil. Also an optimum 5-layer coil has lower loss than the Gallyas 8-layer coil. Thus one can conclude that losses could be reduced to the Gallyas level with only two thirds as many layers as with the Gallyas method.

Table III presents the optimum thickness of the windings in each layer and the current per unit axial length in each layer as a fraction of the current per unit axial length in the outside layer. The outside layer is layer number 1.

TABLE III

| Layer Number i | Optimum thickness $b_i/\delta$ | Optimum Ampere-turns Ratio $N_iI_i/N_1I_1$ |
|---|---|---|
| 1 | 1.571 | 1.000 |
| 2 | .742 | .748 |
| 3 | .563 | .654 |
| 4 | .471 | .600 |
| 5 | .414 | .562 |
| 6 | .373 | .534 |
| 7 | .343 | .512 |
| 8 | .319 | .493 |

With a 2-layer coil, the outside layer thickness would be $1.571\delta$ and the inside layer thickness would be $0.742\delta$. If total current I' amps/cm is required, then, for a coil of length L cm, the total ampere-turns required is:

$$NI = LI'$$

then, $$N_1I_1 + N_2I_2 = NI$$

but, $$N_2I_2/N_1I_1 = 0.748 \text{ from Table III}$$

then $$N_1I_1 = NI/1.748 = 0.572\ NI$$

$$N_2I_2 = 0.748\ NI/1.748 = 0.428\ NI$$

For a 3-layer coil, one obtains

| | |
|---|---|
| $N_1I_1$ = .416 NI | $b_1$ = 1.571 $\delta$ |
| $N_2I_2$ = .312 NI | $b_2$ = .742 $\delta$ |
| $N_3I_3$ = .272 NI | $b_3$ = .563 $\delta$ |

There are two practical approaches to obtaining the desired ampere-turns in each layer. One is to supply each layer with an independent current supply (at identical phase angles for the present analysis to be valid). The second method, which is preferred, is to have equal current in the turns of all layers, but to vary the number of turns per layer so as to achieve the desired current ratios to minimize total losses.

Table IV presents the ratio of turns per layer required when all turns are connected in series, thus having the same current in each turn.

TABLE IV

| Layer Number i | Turns Ratio $N_i/N_1$ | Ideal Width Ratio $W_i/W_1$ |
|---|---|---|
| 1 | 1.0 | 1.0 |
| 2 | .748 ≈ ¾ | 1.337 ≈ 4/3 |
| 3 | .654 ≈ ⅔ | 1.529 ≈ 3/2 |
| 4 | .600 ≈ 3/5 | 1.668 ≈ 5/3 |

Figure 2:
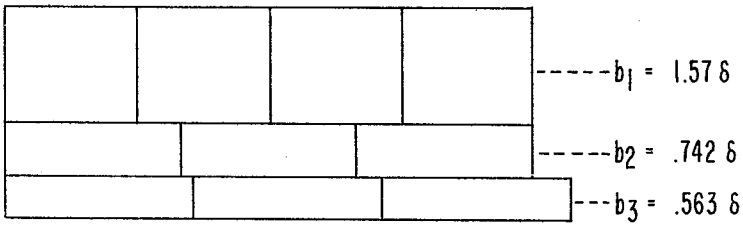
Figure 3:
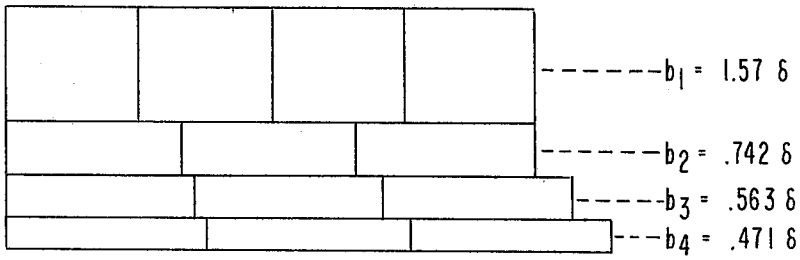

The width ratios in Table III are ideal in that they neglect insulation thickness. FIGS. 1, 2 and 3 illustrate optimum winding geometries for 2-, 3- and 4-layer coils. A different conductor size is used in each layer, with thicknesses proportioned according to Table III and widths or turns proportioned according to Table IV.

The efficiency of an induction heating coil is $$\eta = \frac{p_w}{p_w + p_c}$$

This formula can be applied to express the efficiency of 2- and 3-layer coils as a function of the efficiency of single-layer coils for the same application. For this purpose, it is assumed that loss factors relative to optimum windings are constant when comparing single and multiple layer coils. As expected, the percentage of improvement in efficiency is highest for low efficiency applications. This leads to the following Table V:

TABLE V

| Efficiency of Optimum Single-Layer Coil % | Efficiency of Optimum 2-Layer Coil % | Efficiency of Optimum 3-Layer Coil % |
|---|---|---|
| 40 | 49.2 | 54.5 |
| 50 | 59.3 | 64.3 |
| 60 | 68.6 | 73.0 |
| 70 | 77.2 | 80.7 |
| 80 | 85.3 | 87.8 |

The analytical results show that the loss in each layer is approximately equal to 1/q of the total loss in the optimum winding geometry of a q layer coil. Thus, in an optimum 2-layer coil, each layer would dissipate 0.687/2=0.344 units of power relative to a single-layer coil which produces the same magnetic field, e.g., the same ampere-turns. Thus, when designing cooling circuits the number of parallel coolant paths per layer is reduced by almost a factor of 3 for 2-layer coils. In a 3-layer winding, the loss per layer is $\frac{1}{3}\times 0.556=0.185$. This means that approximately 1/5 as many circuits per layer are required as for a single-layer coil. The above factors are under the assumption that coolant flow per circuit is equal to the flow in a single-layer coil. If pressure drop is the limiting factor, either an increased number of circuits is required, or larger coolant passages will be necessary.

An obvious complication in designing multilayer coils is that of providing access for coolant circuits of the inner layers. It is suggested that at appropriate axial distances, the outer layers must be spaced apart to allow cooling tubes to enter and exit from inner layers. By appropriate staggering of the beginning and end of windings in the various layers, it is possible to provide access with minimum loss of winding space factor. The cooling inlets and exits from inner layers would be positioned to use the same gap in outer layers.

Referring to FIG. 1 a two-layer winding is shown for illustration purposes, which has been designed in accordance with the optimum value of the second data row of Table III. It is observed here that Table III indicates optimum values as provided by the calculation shown in the Appendix, thus, for a minimum value in the basic function representing losses. Therefore, the data given in each column are merely indicative, and the manufacturer can take them as a guidance not as a requirement. Accordingly, for practical reasons, the winding of FIG. 1 is dimensionally characterized by an optimum thickness of $1.57\delta$ for $b_1$ (first and outside layer) and $0.742\delta$ for $b_2$ (second, or inside layer). The corresponding requirement under Table IV is $w_2/w_1=1.337$. As shown by FIG. 1 in good approximation a ratio of $w_2/w_1=1.5$ has been chosen so that the second layer can be evenly distributed with a staggered positioning at $\frac{1}{3}$, $\frac{2}{3}$ and 3/3 relative to the successive junctions of the first layer.

Similarly, FIG. 2 shows a 3-layer winding according to the present invention, e.g., in which according to the third row in Table III, $b_1=1.57$; $b_2=0.742$ and $b_3=0.563$, the corresponding widths $w_3/w_1$ being in a 3/2 ratio, an approximation of 1.529 of Table IV. The distribution of the second layer is as in FIG. 2. The distribution of the third layer admits staggering positions at $\frac{1}{2}$, 2/2, $\frac{1}{2}$ and 2/2, relative to the successive junction of the first layer, all layers being staggered from one another.

FIG. 3 is the same as FIG. 2, with the addition of a fourth layer inwardly. Table III now gives $b_4=0.471$ and Table IV gives $w_4/w_1=1.668$ or 5/3. The distribution of the fourth layer is now according to $\frac{2}{3}$, $\frac{1}{3}$, 3/3 relative to the successive spacings of the junction of the first layer.

The three windings illustrated by FIGS. 1, 2 and 3 are merely indicative of possible concrete applications of the calculations given in the Appendix herein. Many variations are possible in the spirit of Tables III and IV which will provide the benefits resulting from the improved approach according to the present invention, namely, reduced losses by special design of different optimum thicknesses of reduced value from one layer to the next inwardly, and of different widths of increased value from one layer to the next, inwardly, thereby to maintain the total current per conductor of each winding the same.

Figure 4:
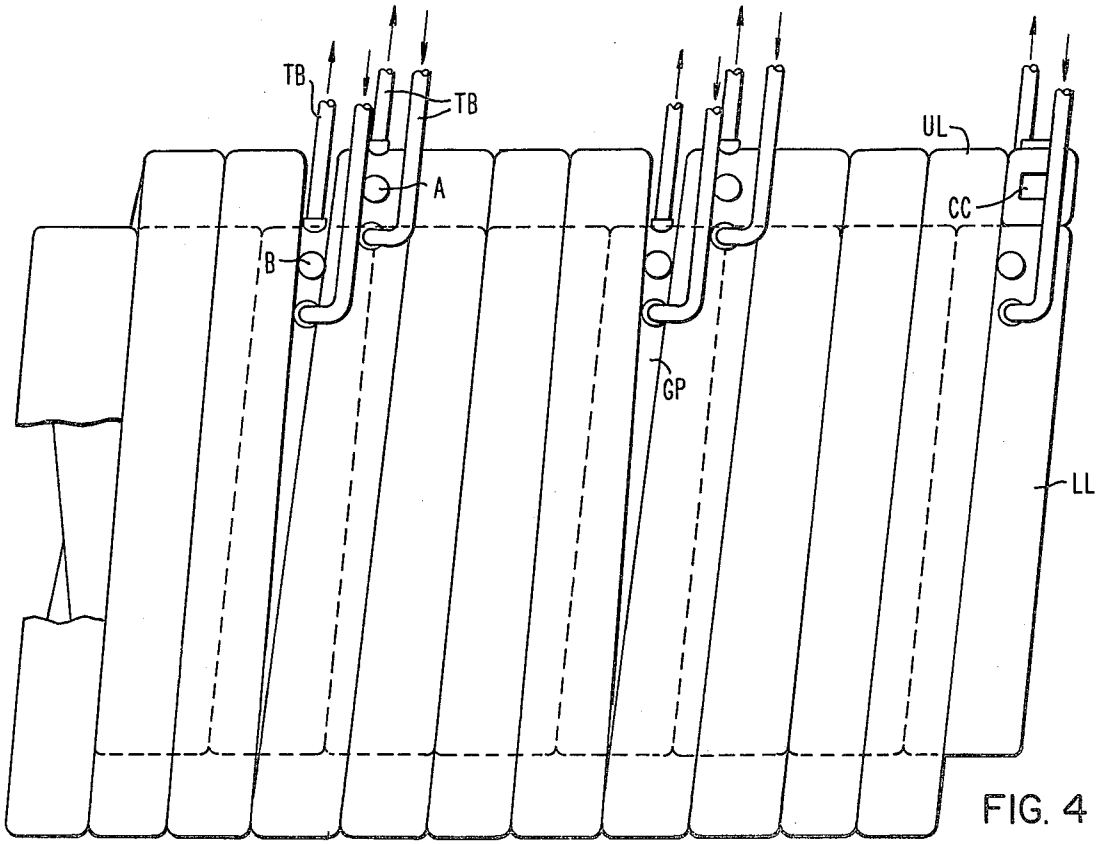
FIG. 4 is a developed view of a multilayer winding according to the invention to illustrate the accommodation therein of central cooling of the conductors.

Referring to FIG. 4, a two-layer winding such as in FIG. 1, is shown to indicate how central cooling of the conductor can be practiced on such a winding. It appears that a plug A is inserted at one extremity of the winding inside the central conduit CC of the upper layer conductor UL which central conduit extends in the copper over the entire length thereof. Transversely of the conductor near Plug A, a tube TB mounted through the copper wall provides cooling fluid access to the central conduit. The central conduit allows internal cooling through the ampere-turns down to the end of a section which ends in front of a second plug B at the mouth of another tube TB used as the exit of the section for the cooling medium flowing through the copper wall. Similarly, the cooling medium is admitted through a tube TB on the other side of the plug B, into the adjoining section.

While cooling of the outside layer UL only requires alternate inlets and outlets such as TB from section to section, some gaps (indicated by GP in FIG. 4) between ampere-turns have been provided at some spaced locations in the outer layer UL in order to accommodate ingress and egress for tubes like TB with regard to the lower or inner layer LL.

APPENDIX

Calculations of Dimensions for Minimum Loss Windings for Multilayer Solenoids It is known that the power delivered to the workpiece by an induction coil is proportional to the square of the magnetic field strength, $H_o$, produced by the coil. Thus, a coil design which minimizes the coil power loss for any specified value of $H_o$ with result in maximum heating efficiency.

Considering a long solenoid wound with concentric layers of conductors, or windings, the layers are numbered sequentially from the outside, with the outside layer denoted as layer 1. The thickness of the layer of rank i is $t_i$. The current (ampere-turns) per unit axial length in layer i is $H_i$. Then the magnetic field strength produced by the overall solenoid is $$H_o = \sum_{i=1}^{q} H_i \tag{1}$$

where q is the total number of layers.

In order to choose $t_i$ and $H_i$ such that for a given $H_o$, the total loss in the q layers of the coil is a minimum, the following calculation steps are taken:

If, $$S_i = \sum_{m=1}^{i} H_m \tag{2}$$

where, $$S_i = H_m + S_{i-1}$$

and, $$S_o = 0$$

with $S_i$ being the magnetic field due to all layers of rank 1 up to i and $H_m$ is the magnetic field due to the layer of rank i provided the thickness of a layer is small relative to the diameter of the layer, the magnetic field within the layer satisfies the phasor equation $$\bar{j} k^2 \hat{H} = \frac{\partial^2 \hat{H}}{\partial y^2} \tag{3}$$

where, $$k = \sqrt{2/\delta}$$

$$\bar{j} = \sqrt{-1}$$

$y$ = radial distance from the inside of the layer.

$H$ = real part of $\hat{H} e^{\bar{j}wt}$.

The boundary conditions for layer i are $$H(t_i) = S_{i-1} \tag{4}$$

$$H(O) = S_i \tag{5}$$

and the phasor current density at the radial distance y within the layer is $$\hat{J} = -\frac{\partial \hat{H}}{\partial y} \tag{6}$$

where

J = current density = Real part of $\hat{J} e^{\bar{j}wt}$.

The solution of equations (3) to (6) yields $$J^2(y) = \frac{2\phi^2}{\delta^2 \left[ \sinh^2 \frac{t_i}{\delta} + \sin^2 \frac{t_i}{\delta} \right]}$$

-continued $$\phi^2 = \tfrac{1}{2} S_{i-1}^2 \left[ \cos \frac{2y}{\delta} + \cosh \frac{2y}{\delta} \right] + \tfrac{1}{2} S_i^2 \left[ \cos^2 \frac{(t_i - y)}{\delta} + \cosh^2 \frac{(t_i - y)}{\delta} \right] + S_i S_{i-1} \left[ \sinh \frac{t_i}{\delta} \cos \frac{t_i}{\delta} \sinh \frac{2y}{\delta} \right] - S_i S_{i-1} \left[ \cosh \frac{t_i}{\delta} \sin \frac{t_i}{\delta} \sin \frac{2y}{\delta} \right] - S_i S_{i-1} \left[ \cosh \frac{t_i}{\delta} \cos \frac{t_i}{\delta} \right] \left[ \cosh \frac{2y}{\delta} + \cos \frac{2y}{\delta} \right]$$

From this current density distribution, the loss in layer i can be shown to be $$P_i = \frac{\pi \rho d_i}{\delta} \left[ (S_{i-1}^2 + S_i^2) F_1\left(\frac{t_i}{\delta}\right) - S_i S_{i-1} F_2\left(\frac{t_1}{\delta}\right) \right]$$

where $P_i$ = loss per unit axial length in layer i $\delta$ = current penetration depth for the winding conductor $H_i$ = r.m.s. current per unit axial length in layer i $t_i$ = thickness of layer i $\rho$ = electrical resistivity of the winding $d_i$ = mean diameter of layer i $$F_1(x) = \frac{\sinh 2x + \sin 2x}{\cosh 2x - \cos 2x}$$

$$F_2(x) = \frac{4(\sinh x \cos x + \cosh x \sin x)}{\cosh 2x - \cos 2x}$$

The total loss in a coil of q layers is then:

$$P_{Tq} = \sum_{i=1}^{q} P_i$$

In order to simplify, it is now assumed that the mean diameters of each layer are approximately equal, that is, $d_i = D$ = constant. With this approximation, the results are independent of coil diameter and frequency. From the above expressions, it is seen that the total loss per unit axial length in a q layer coil is a function of the thickness $t_i$ of each layer and of the fraction of the magnetic field produced by each layer (current per unit axial length). The q values of $H_i$ contain only q−1 degrees of freedom since their sum is Ho. The distribution of current in a q layer coil can be conveniently represented by q−1 values of ratio $r_i$ where $$S_1 = r_1 S_2$$

$$S_2 = r_2 S_3$$

$$S_{q-1} = r_{q-1} S_q = r_{q-1} Ho$$

Then, the total loss in a q layer coil with $q \geqq 2$ is $$P_{Tq} = r_{q-1}^2 P_{Tq-1} + P_q$$

where $$P_q = \frac{\pi D \rho H_o^2}{\delta}\left[(1 + r_{q-1}^2) F_1\left(\frac{t_q}{\delta}\right) - r_{q-1}F_2\left(\frac{t_q}{\delta}\right)\right]$$

The total loss is minimized with respect to q values of $t_i$ and q−1 values of r when:

$$\partial P_{Tg}/\partial t_i = o; \ (i=1,2, \ldots q)$$

$$\partial P_{TQ}/\partial r_i = o; \ (i=1,2, \ldots q-1)$$

Single Layer Coil

The loss in a single layer coil is $$P_{T1} = \frac{\pi D \rho}{\delta} H_o^2 F_1\left(\frac{t_1}{\delta}\right)$$

which is optimized by the condition $$\frac{dP_{T1}}{\partial t_i} = \frac{\pi D \rho H_o^2}{\delta} \cdot \frac{\partial F_1\left(\frac{t_1}{\delta}\right)}{\partial t_i} = o$$

The value of $t_i$ which satisfies this condition is $$t_1^* = (\pi/2)\ \partial$$

Two Layer Coil

The loss in a two layer coil is $$P_{T2} = \frac{\pi D \rho H_o^2}{\delta}\left[r_1^2 F_1\left(\frac{t_i}{\delta}\right) + (1 = r_q^2) F_1\left(\frac{t_2}{\delta}\right) - r_1 F_2\left(\frac{t_2}{\delta}\right)\right]$$

and the optimizing conditions give $$\frac{\partial F_1\left(\frac{t_1}{\delta}\right)}{\partial t_1} = o$$

$$(1 + r_1^2)\frac{\partial F_1\left(\frac{t_2}{\delta}\right)}{\partial t_2} - r_1 \frac{\partial F_2\left(\frac{t_2}{\delta}\right)}{\partial t_2} = o$$

$$2r_1\left[F_1\left(\frac{t_1}{\delta}\right) + F_2\left(\frac{t_1}{\delta}\right)\right] - F_2\left(\frac{t_2}{\delta}\right) = o$$

The first condition is the same as the one for a single layer coil and is only a function of $t_1$. Thus, $t_1^* = (\pi/2)\ \partial$ as before. The last two conditions can be solved numerically to obtain $$r_1^* = 0.572049$$

$$t_2^* = 0.742202\ \partial$$

and the corresponding value of $P_{T2}$ is $$P_{T2}^* = 0.6784\ P_{T1}^*$$

The ampere-turns per unit axial length in the first layer are:

$$H_1 = 0.572049\ H_o$$

and in the second layer are $$H_2 = (1 - r_1^*)H_o = 0.427951 H_o$$

Thus, the ratio of ampere-turns in layer 2 to ampere-turns in layer 1 is:

$$\frac{N_2 I_2}{N_1 I_2} = \frac{H_2}{H_1} = \frac{.427951}{.572049} = .748101$$

Three Layer Coil

Repeating the procedure above gives $$t_1^* = (\pi/2)\ \partial$$

$$t_2^* = 0.742202\ \partial$$

$$t_3^* = 0.562519\ \partial$$

$$r_1^* = 0.5729049$$

$$r_2^* = 0.727708$$

which in turn gives $$N_3 I_3 / N_1 I_1 = H_3 / H_1 = 0.654101$$

$$N_2 I_2 / N_1 I_1 = 0.748101$$

and $$P_{T3}^* = 0.5559\ P_{T1}^*$$

The optimization results for coils with up to 8 layers are given in the heretofore given Tables II and III. These results include total coil loss, optimum layer thickness and ampere-turn ratios for the various layers.

I claim:

1. A multilayer electrical winding disposed about an axis, comprising:

at least two layers respectively including a first plurality of ampere turns in one of said layers and a second plurality of ampere turns in another of said layers;

the ampere turns of each plurality being formed with a single conductor having radially of said axis a common thickness and longitudinally of said axis a common width;

the common thicknesses and widths of said pluralities being selected to form respective monotone progressions in opposite directions as defined from the outside of said winding toward the inside thereof;

with the common thicknesses thereof being such that for the first layer $b_i/\delta$ has a value selected between 1.5 and 1.65; that for the second layer $b_i/\delta$ has a value selected between 0.65 and 0.8, where $b_i$ is the layer thickness for the layer of rank i in said winding and $\delta$ is the effective depth of current penetration radially of said winding; and with the ratio $w_i/w_1$ being selected between 1.2 and 1.45, where $w_1$ is the width of the conductor in the first layer, and $w_i$ is the width of the conductor of rank i;

thereby to minimize resistance and eddy current losses in said at least two windings;

with the conductors of two adjacent layers being connected at a common and adjacent end.

2. The multilayer electrical winding of claim 1, with said winding having at least three layers; with the common thicknesses thereof being such that for the third layer $b_i/\delta$ has a value selected between 0.50 and 0.65; and with the width ratio $w_i/w_1$ being selected between 1.45 and 1.58.

3. The multilayer electrical winding of claim 1, with said winding having four layers; with the common thicknesses thereof being such that for the fourth layer $b_i/\delta$ has a value selected between 0.43 and 0.50; and with the width ratio $w_i/w_1$ being selected between 1.58 and 1.75.

4. The multilayer electrical winding of claim 1, with said winding having four layers; with the common thicknesses thereof being such that for the fourth layer $b_i/\delta$ has a value selected between 0.39 and 0.43; and with the width ratio $w_i/w_1$ being selected between 1.75 and 1.85.

5. The multilayer electrical winding of claim 1, with said conductor having a central conduit for providing central cooling thereof with a cooling fluid therethrough with the central conduit having plug means at each end of a layer for closing the central conduit of the associated conductor; means being provided for fluid entry and for fluid exit at respective opposite ends of the conductor in each layer.

6. The multilayer electrical winding of claim 5, with each conductor of a layer being divided into sections, plug means being provided at the end of each section in conjunction with fluid entry and fluid exit means at the respective ends of such section.

7. The multilayer electrical winding of claim 6, with spacings being provided between the ampere-turns of an outer layer for accommodating passage of the cooling fluid via the fluid entry and fluid exit means of an inner layer.

* * * * *